US011207882B2

(12) United States Patent
Schneider

(10) Patent No.: US 11,207,882 B2
(45) Date of Patent: Dec. 28, 2021

(54) METHOD AND DEVICE FOR CONTROLLING AN ACTUATOR OF AN INKJET PRINTING SYSTEM

(71) Applicant: Canon Production Printing Holding B.V., Venlo (NL)

(72) Inventor: Claus Schneider, Eching (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/801,751

(22) Filed: Feb. 26, 2020

(65) Prior Publication Data

US 2020/0269565 A1 Aug. 27, 2020

(30) Foreign Application Priority Data

Feb. 27, 2019 (DE) ..... 102019104931.8

(51) Int. Cl.
*B41J 2/045* (2006.01)
*B41J 2/165* (2006.01)

(52) U.S. Cl.
CPC ..... *B41J 2/0451* (2013.01); *B41J 2/16517* (2013.01); *B41J 2002/16573* (2013.01)

(58) Field of Classification Search
CPC ..... B41J 2/0451; B41J 2/16517; B41J 2002/16573
See application file for complete search history.

(56) References Cited

U.S. PATENT DOCUMENTS 5,659,342 A 8/1997 Lund et al.
9,044,937 B2 6/2015 Buschmann
9,120,306 B2 9/2015 Buschmann
9,205,645 B2 12/2015 Koerner
9,302,474 B2 4/2016 Koerner et al.
2004/0246293 A1 12/2004 Sanpei et al.
2008/0186341 A1 8/2008 Hirato
2013/0187973 A1 7/2013 De Smet et al.
2016/0167364 A1 6/2016 Matsumoto et al.
2018/0056650 A1* 3/2018 Hettler ..... B41J 2/16585
2019/0047284 A1* 2/2019 Hettler ..... B41J 2/04573

FOREIGN PATENT DOCUMENTS

DE 69506820 T2 5/1999
DE 102012107775 A1 2/2014
DE 102012110187 A1 4/2014
DE 102014101428 A1 8/2015
DE 102014106424 A1 11/2015
WO WO-2015181228 A1 * 12/2015 ..... B41J 2/16588

OTHER PUBLICATIONS

German action dated Oct. 18, 2019, for Application 10 2019 104 931.8.

* cited by examiner

*Primary Examiner* — Sharon Polk
(74) *Attorney, Agent, or Firm* — Schiff Hardin LLP

(57) ABSTRACT

In an inkjet printing system, an actuator that is associated with a nozzle of a printing element is controlled in a normal operating mode, given a non-defective nozzle, to implement at least one standard refresh measure if the time period in which the actuator is not activated to output an ink droplet exceeds a preset limit value. After detection of a defective nozzle, the actuator is controlled in an error operating mode to implement at least one intensified refresh measure.

15 Claims, 3 Drawing Sheets

METHOD AND DEVICE FOR CONTROLLING AN ACTUATOR OF AN INKJET PRINTING SYSTEM

CROSS REFERENCE TO RELATED APPLICATIONS

This patent application claims priority to German Patent Application No. 102019104931.8, filed Feb. 27, 2019, which is incorporated herein by reference in its entirety.

BACKGROUND

Field

The disclosure relates to a method and a device for controlling an actuator of an inkjet printing system, in which at least one actuator is associated with a printing element, wherein the actuator can be controlled to output an ink droplet from a nozzle of the printing element.

Related Art

Inkjet printing apparatuses may be used for single- or multicolor printing to a recording medium. The design of such an inkjet printing apparatus is known from DE 10 2014 106 424 A1=U.S. Pat. No. 9,302,474 B2, for example. Such an inkjet printing apparatus has at least one print group with at least one print bar per print color. The print bar is arranged transversal to the transport direction of the recording medium and may have a plurality of print heads that respectively include a plurality of printing elements with nozzles, in order to eject ink droplets from the nozzles. Each dot of a print line transversal to the printing direction is respectively printed by a different nozzle. The nozzles thus print ink droplets line by line in chronological succession in the longitudinal direction onto the recording medium. The higher the print resolution transversal to the transport direction of the recording medium, the more nozzles that are arranged in the print heads.

If the viscosity of the ink within a nozzle rises too severely, the danger exists that the surface of the ink dries, or that the ink dries out. This has the result that the nozzle clogs at least partially, such that an ink droplet can no longer be ejected and/or its desired ejection direction is altered due to impeding ink residues. The ink droplets are thereby printed at a pixel or print position deviating from the desired position.

The greater the time interval between the ejection of two successive ink droplets from a nozzle, the greater the danger of drying. The information about the activities and inactivity of the nozzles is known from the print data that are supplied to the printer control by a controller.

Various refresh measures that should prevent the ink from drying out are known from the prior art. The refresh measures are implemented during the inactive times of the nozzle, which are known to the controller. The times of inactivity of the nozzles are also referred to as "dead times". The refresh measures are in particular implemented when the dead times exceed a preset limit value. Otherwise, the drying out of the ink is prevented by the normal ink ejection.

For example, the refresh measures include methods in which multiple vibration cycles are inserted during the dead time. During a vibration cycle, the actuator is controlled with a predetermined waveform such that the ink meniscus at the output of the nozzle is set into vibration without an ink droplet being ejected. The ink at the end of the nozzle channel is intermixed due to the vibration, such that higher-viscosity ink in contact with air is intermixed with fresh ink of lower viscosity from the ink chamber or the inside of the nozzle channel. The viscosity thus does not rise too quickly relative to a print pause without vibrations at the nozzle exit, and the danger of clogging of the nozzle is reduced.

Given multiple known inkjet printing apparatuses (DE 10 2014 101 428 A1=U.S. Pat. No. 9,205,645 B2, DE 10 2012 110 187 A1=U.S. Pat. No. 9,120,306 B2, and DE 10 2012 107 775 A1=U.S. Pat. No. 9,044,937 B2), meniscus vibrations are implemented depending on the size of the ejected ink droplets, depending on the velocity in the delay or acceleration ramps upon printing, and/or depending on the duration of the print pauses.

From the prior art, refresh measures are also known in which the actuator is controlled to output at least one ink droplet such that the output ink droplet inks a randomly selected point of the print image on the recording medium, independently of print data. Alternatively or additionally, depending on print data the output ink droplet may ink an already inked point of the print image to be generated on the recording medium, wherein the already inked point has been inked with a first color and the ink droplet has a second color differing from the first color. It is thereby achieved that the ink in the ink chamber and the nozzle channel may be refreshed via the ejection of these "random dots", which are barely detectable in the print image, during the print operation, and the danger of drying is reduced.

The drying of the ink in the nozzles may also be prevented in that printing takes place from all nozzles within a predetermined cycle. This cycle may be adjusted corresponding to the print utilization. Individual dots may thereby be applied in regions of the recording medium that will not be processed further into print goods, or dot lines and/or individual lines may be printed between print pages. However, these methods may lead to disruptions in the print image and to unnecessary ink consumption and additional wear of the print heads. These methods also lead to an increased paper consumption, since the regions at which the individual dots are applied must be cut away.

The drying out of the nozzles should be prevented a priori with the known methods. However, if the ink has already dried and the nozzle is clogged, the failure may only be remedied in the course of maintenance measures in which, for example, ink or cleaning fluid is flushed or pressed through the nozzles of the print head. The print operation is normally interrupted in the course of these maintenance measures, whereby the productivity of the printing apparatus is reduced. These maintenance measures normally also lead to a high ink consumption.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
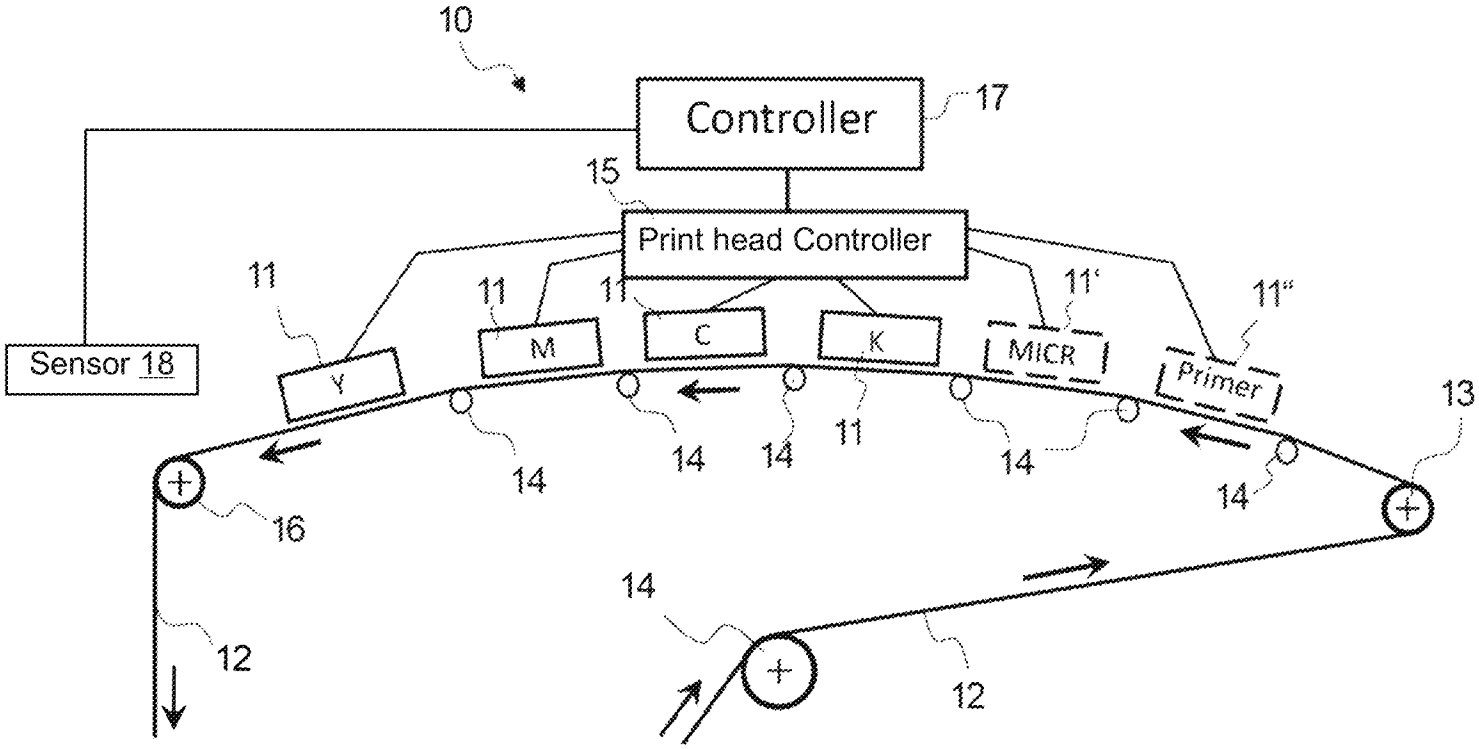
FIG. 1 (Related Art)
FIG. 1 illustrates an example of a print group.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the disclosure is to provide a method and a device in which the nozzles may print for an optimally long period of time without maintenance.

In an exemplary embodiment of the present disclosure, in a normal operating mode, the actuator is controlled to output the ink droplet onto a predetermined point to be inked on a recording medium, depending on a print image to be generated, wherein in the normal operating mode, given a non-defective nozzle, the actuator is controlled to implement at least one standard refresh measure if the time period in which the actuator is not activated to output an ink droplet exceeds a preset limit value. After detection of a defective or partially defective nozzle, the actuator is controlled in an error operating mode to implement at least one intensified refresh measure. In that intensified refresh measures are implemented given a defective nozzle, the advantage is achieved that a remedying of the defect of the nozzle may already take place during the print operation. Maintenance interruptions in which no print operation is possible are thereby become at least partially unnecessary. This results in an increase of the productivity of the printing system.

A print group of a known inkjet printing apparatus is depicted in FIG. 1 (for example DE 10 2014 106 424 A1=U.S. Pat. No. 9,302,474 B2, which are incorporated by reference in their entirety). Such a print group 10 has per color at least one print bar 11 having one or more print heads that are arranged transversal to the transport direction (represented by corresponding arrows in the FIG. 1) of a recording medium 12. Transversal to the printing direction, a printing element 20 (depicted in FIG. 2) is associated with each dot of a print line such that the progressing recording medium 12 may be printed to with a droplet of desired fluid (ink/color) in a line clock cycle and with a corresponding print resolution per line.

Four primary colors are typically necessary for full color printing, and in fact CMYK (cyan, magenta, yellow, and black=K). Additional inks in green, orange, or violet expand the color gamut of the printer. Moreover, further colors or special inks, such as MICR ink (Magnetic Ink Character Recognition=magnetically readable ink) may additionally be present. All colors/inks are respectively printed with a separate print bar 11, 11'. It is likewise possible that transparent special fluids such as primer or drying promoters are likewise digitally applied with a separate print bar 11" before or after the printing of the print image in order to improve the print quality or the adhesion of the ink on the recording medium 12.

A line width can be printed with a print bar 11, 11', 11". Each dot along a line is printed by a separate printing element 20 (see FIG. 2) of the print bar 11, 11', 11". the print resolution in the print line direction (transversal to the transport direction) is determined by the pitches (distances) from one another of the dots printed on the recording medium by the printing elements 20. By contrast, the print resolution in the transport direction is determined by the transport velocity and the line timing of the print heads given line-clocked printing.

A recording medium 12 in the form of a web is directed, via a feed roller 13 and a plurality of deflection rollers 14, below the print bars 11 with the printing elements 20. The individual printing elements 20 are activated with control signals via a print head control 15, corresponding to the desired image data. The image data are transferred from a host (not shown) to a controller 17 that prepares the entirety of the print information for printing and relays it to the respective print head control 15 of each print bar 11.

The recording medium 12 is guided through the print group 10, and the printing elements 20 are controlled according to the desired print image so that the individual ink droplets may respectively be applied exactly onto the desired image position of the recording medium 12. With a takeoff roller 16, the recording medium 12 is guided further to a drying (not shown) and, if applicable, to a subsequent additional print group in which in particular the back side of the recording medium 12 may then be printed to. The recording medium 12 may subsequently be supplied to a post-processing in which the recording medium 12 is then cut, folded, or finally processed in other work steps.

Figure 2:
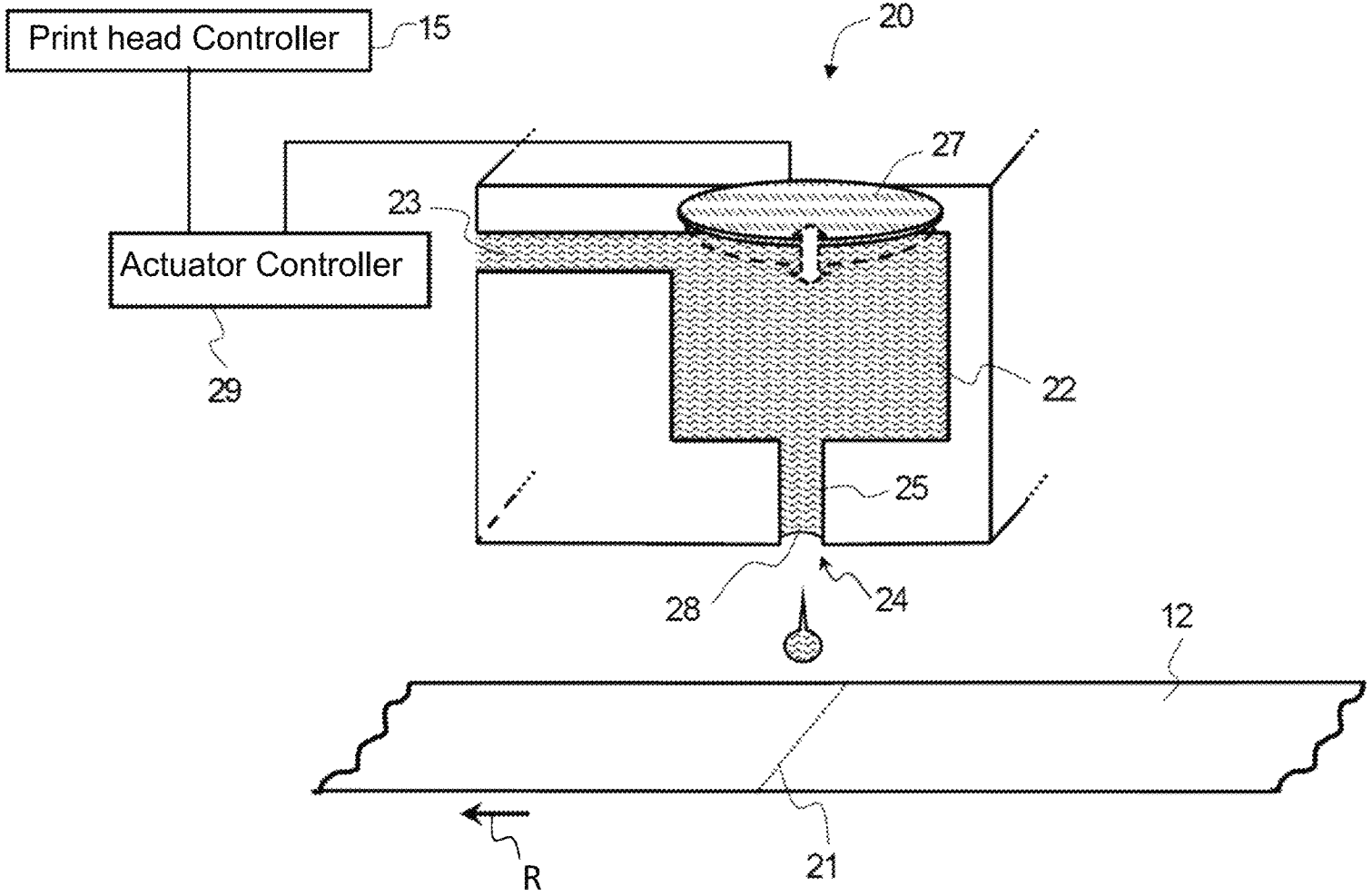
FIG. 2 illustrates a printing element of a print head of the print group according to FIG. 1.

An individual printing element 20, according to an exemplary embodiment, of a print head is shown in FIG. 2. In an exemplary embodiment, the printing element 20 includes an ink chamber 22 that is filled with fresh ink via an ink supply 23, or which is refilled with fresh ink. An ink droplet may be ejected via a nozzle 24 having a nozzle channel 25. An actuator 27 is arranged in the ink chamber 22 or in the nozzle channel to generate an ink droplet. In an exemplary embodiment, with a pulsed control signal, the actuator 27 is controlled by an actuator controller 29 to output an ink droplet depending on the print data that arrive from the controller 17 via the print head controller 15. The control signal has a predetermined waveform having one or more pulses. Via the control signal, the actuator 27 is activated such that the ink in the ink chamber 22 is set into oscillation. In an exemplary embodiment, the controller 17, print head controller 15, and/or actuator controller 29 include processor circuitry that is configured to perform one or more respective functions and/or operations of the controller 17, print head controller 15, and/or actuator controller 29.

If a piezoelectric element is used as an actuator 27, the piezoelectric element expands (see double arrow and dashed line in FIG. 2) as soon as it is accordingly activated, and thereby sets the ink in the ink chamber 22, and in particular in the nozzle channel 25, into oscillation corresponding to the waveform.

The control signal has a complex waveform that ensures that the actuator 27 briefly expands and contracts again repeatedly. Due to this alternating application of negative pressure/positive pressure on the ink, this is set into a corresponding oscillation such that ink droplets may be pressed from the nozzle 24. Depending on the waveform (frequencies, amplitudes, rise or fall times of the pulses, pulse/pause ratios, signal energy etc.), the ink droplets may be ejected from the nozzle 24 in different sizes or with different velocity.

In printing mode, the inkjet printing apparatus may drive the recording medium 12 in the form of a web with a constant velocity of 100 m/min, for example. The recording medium 12 is hereby directed in the arrow direction through the print group 10, past the print bars 11, 11', 11". The printing elements 20 are arranged transversal to the transport direction R. As soon as the recording medium 12 has moved on by a predetermined distance, the actuators 27 of the printing elements 20 are activated corresponding to the image data. The distance thereby corresponds to the resolution in the transport direction R and is also defined as a print line width (or pixel width). The printing elements 20 are controlled in the print line clock cycle such that print lines 21 orthogonal to the transport direction R may be printed successively at the same pixel pitch, print line 21 for print line 21, according to the desired image data. The corresponding ink droplets thus respectively arrive, according to the line clock cycle, exactly at the desired image position on the recording medium 12.

Only given a monochrome, full-surface print image over the entire printing region of a page are ink droplets continuously ejected from all nozzles 24 of the corresponding print bar 11, 11', 11". The degree of ink coverage on a page is typically markedly less, primarily when a great deal of text is used for the print image. In this instance, the degree of coverage may be between 2% and 5% for a colored ink, for example. All printing elements 20 are thus not always active in order to eject an ink droplet. In particular in the edge region, the associated printing elements 20 may be inactive for a longer period of time, since often no print image is printed there.

If no ink droplet is ejected from a nozzle 24 for a defined length of time, the danger exists that the ink dries in this nozzle 24. Ink has special specific chemical components so that the ink does not dry in an enclosed space, but by contrast dries rapidly on the recording medium 12. The viscosity of the ink increases due to the contact with air at the output of the nozzle 24, so that this tends to dry out.

With an increase in the viscosity, the oscillation behavior of the ink in the nozzle channel 25 changes until a standstill in the event that the nozzle 24 is completely sealed by dried ink, which corresponds to a total failure of the nozzle 24. This leads to a degraded print quality. The total failure of a nozzle 24 is visible in the print image as lighter stripes in an area that is otherwise printed over an entire surface. A partial clogging of the nozzle 24 likewise makes itself apparent as streaking, since only smaller ink droplets may be ejected (lower intensity) and/or the ejection direction is askew, which leads to an altered image position.

In an exemplary embodiment, to prevent the drying of the ink, in a normal operating mode standard refresh measures are implemented during the printing operation if the dead time of the nozzle 24 exceeds a preset limit value. In an exemplary embodiment, these measures may be implemented individually or in combination, and include:

- the implementation of what are known as vibration cycles or prefire actions in which a vibration of the ink meniscus at the output of the nozzle 24 takes place without ejection of an ink droplet,
- the ejection of ink from all nozzles 24 within predetermined time intervals, preferably in what are known as multicolor lines that are printed outside of the print image to be generated,
- the output of at least one ink droplet having a small or a medium volume, such that the output ink droplet inks a randomly selected point of the print image on the recording medium 12, independently of print data,
- the output of an ink droplet having the small or medium volume, such that the output ink droplet inks an already inked point of the print image to be generated on the recording medium 12 depending on print data, wherein the already inked point has been inked with a first color, and the ink droplet has a second color differing from the first color. For example, an ink droplet that has the color yellow, magenta, or cyan may be printed on a point of the print image that is to be generated that is inked black.

In spite of the aforementioned measures, a drying out of the ink cannot always be prevented with certainty, such that a defect of the nozzle 24 may occur. The defect of the nozzle 24 is detected in particular when the position of the inked point on the recording medium 12 deviates from a predetermined position, and/or when the size of the inked point deviates from a predetermined size, and/or when a point to be inked has not been inked. The defect may be detected by a user upon visual evaluation of the generated print images. Alternatively or additionally, a sensor unit 18 may be provided, in particular a camera, wherein a defect of the nozzle is detected via an automatic evaluation of the images detected by the sensor unit 18.

As soon as the defect of the nozzle 24 of the printing element 20 is detected, a corresponding error information is relayed automatically from the sensor unit 18 or manually by the user to the controller 17. The controller 17 relays the error information to the print head controller 15, which no longer controls the actuator 27 in normal operating mode but rather in an error operating mode, such that at least one intensified refresh measure is implemented for the defective nozzle 24. The goal of the intensified refresh measures is to remedy the defect of the nozzle 24 during the print operation. This means that the print operation of the printing elements with non-defective nozzles is not interrupted; rather, these continue to be controlled in the normal operating mode.

In an exemplary embodiment, the intensified refresh measures include the following measures, individually or in combination:

- the implementation of vibration cycles or prefire reactions, wherein, by comparison to the vibration signal in normal operating mode, the vibration signal in error operating mode has higher pulse amplitudes and/or a greater proportion of pulse amplitudes above an amplitude threshold and/or higher mean pulse widths and/or a greater number of pulses within the signal duration and/or a higher frequency,
- the activation of the actuator 27 to output at least one ink droplet with a large volume, such that the output ink droplet inks a randomly selected point of the print image on the recording medium 12, independently of print data, and/or
- the activation of the actuator 27 to output an ink droplet with the large volume, such that the output ink droplet inks an already inked point of the print image to be generated on the recording medium 12 depending on print data, wherein the already inked point has been inked with a first color, and the ink droplet has a second color differing from the first color.

Instead of an ink droplet with the large volume, the ejection of two ink droplets with the medium volume may also be activated via a double pulse in the intensified refresh measures.

In an exemplary embodiment, during operation in error operating mode, the failure of the printing element 20 is compensated with the aid of printing elements that are not defective. In an exemplary embodiment, one or more of the following compensation measures may be used:

Control the actuator of a printing element adjacent to the defective printing element 20 such that an ink droplet with the large volume is ejected. It is thereby achieved that the dot that should be printed by the printing element 20 is at least partially covered with the predetermined color with the aid of the adjacent printing element.

Print the dot that should be printed by the printing element 20 with a color that differs from the color of the ink of the printing element 20. For example, a predetermined black dot may be printed with the colors cyan and/or magenta; a predetermined cyan-colored dot may be printed with the color magenta; a predetermined magenta-colored dot may be printed with the color cyan. Given a provided yellow dot, the compensation via a different color may in particular be foregone.

Figure 3:
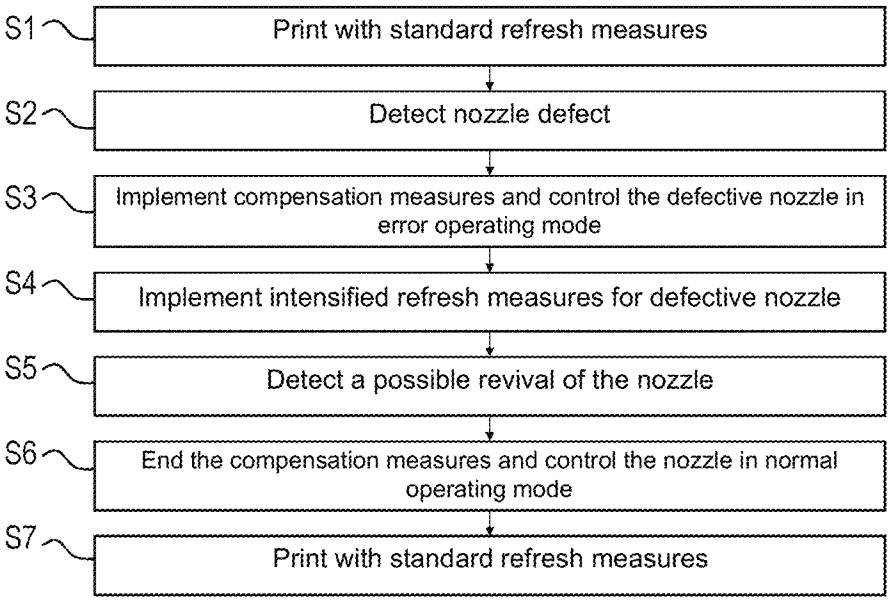
FIG. 3 illustrates a flowchart of a method for controlling an actuator of the printing element according to FIG. 2.

FIG. 3 shows a flowchart of a method for controlling an actuator 27 according to an exemplary embodiment, and is described in connection with FIG. 2. Initially, in step S1 standard refresh measures are implemented in normal operating mode if the dead time of the printing element 20 exceeds a preset limit value. In the next step S2, a defect of the nozzle 24 is detected by the operator or with the aid of the sensor unit 18. In step S3, the nozzle 24 is controlled in error operating mode as of the point in time of the detection of the defect. At the same time, the failure of the nozzle is compensated for via typical compensation measures. In error operating mode, intensified refresh measures are implemented in step S4 for the defective nozzle 24.

Given a successful implementation of the intensified refresh measures, a revival of the nozzle 24—meaning a reestablishment of full functionality—is possible. In step S5, the revival is detected. To detect the revival, the nozzle 24 may in particular be activated to output ink droplets in the multicolor lines. As soon as the revival is detected by the sensor unit 18, a corresponding information is relayed to the controller 17. The controller 17 relays the information to the print head controller 15. In step S6, the print head control ends the compensation measures and controls the nozzle 24 in normal operating mode again. In step S7, standard refresh measures are implemented in normal operating mode analogous to step S1.

Via the method described above, the advantage is achieved that defective nozzles 24 may be activated again during the print operation. However, particularly tenacious clogs of the nozzle 24 may lead to the situation that these are not activated again in spite of intensified refresh measures.

In a particularly advantageous embodiment, at the point in time of the detection of the defect of the nozzle 24, an error signal is generated with the aid of a sensor unit 18 and output to the controller 17 if intensified refresh measures have already been implemented at said nozzle 24 over a predetermined time period, wherein the controller 17 outputs error information to a user, and/or wherein the controller 17 ends the print process, and/or wherein the controller 17 activates a cleaning process to clean the print bar, and/or initiates a maintenance process to service the defective nozzle 24.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 print group
11 print bar
12 recording medium
13 intake roller
14 deflection roller
15 print head controller
16 takeoff roller
17 controller
18 sensor unit
20 printing element
21 print line
22 ink chamber
23 ink supply
24 nozzle
25 nozzle channel
27 actuator
28 ink meniscus
29 actuator controller
R transport direction

The invention claimed is:

1. A method for controlling an actuator of an inkjet printing system, comprising:

in a normal operating mode, controlling, by a controller, at least one actuator associated with a printing element, based on a print image to be generated, to output one or more ink droplets from a nozzle of the printing element to a predetermined point to be inked on a recording medium, wherein the controlling of the at least one actuator in the normal operating mode to output ink droplets from the nozzle comprises: depending on print data of the print image to be generated, selectively outputting, from the nozzle two ink droplets having a first volume, or a single ink droplet having a second volume larger than the first volume;

determining, by the controller, a time period in which the at least one actuator has not been activated to output an ink droplet;

with a non-defective nozzle, controlling, by the controller, the at least one actuator in the normal operating mode to implement at least one refresh measure in response to the determined time period exceeding a preset limit value; and in response to a detection of a defective nozzle by a sensor, controlling the at least one actuator, by the controller, to implement at least one intensified refresh measure in an error operating mode, wherein the at least one refresh measure comprises at least one of:

controlling the at least one actuator with a vibration signal preset for the normal operating mode, and/or controlling the at least one actuator to output at least one ink droplet having the first volume such that the output ink droplet inks a randomly selected point of the print image on the recording medium, independently of print data;

controlling the at least one actuator to output an ink droplet having the first volume such that the output ink droplet inks an already printed point of the print image to be generated on the recording medium depending on the print data, wherein the already inked point has been inked with a first color, and the ink droplet has a second color differing from the first color; and controlling the at least one actuator to output an ink droplet having the first volume, wherein the ink droplet inks a predetermined point outside of the print image to be generated.

2. The method according to claim 1, wherein the at least one actuator is a piezoelectric actuator is controlled with pulsed signals, wherein:

ink droplets are ejected from the nozzle in response to the pulsed signal being an ejection signal, and an ink meniscus at an output of the nozzle vibrates without ejection of the ink droplet in response to the pulsed signal being a vibration signal, wherein the vibration signal is adjustable with respect to: pulse amplitudes, a proportion of the pulse amplitudes above an amplitude threshold, a mean pulse width, and/or a number of pulses within a signal duration.

3. The method according to claim 1, wherein the at least one intensified refresh measure comprises at least one of:

controlling the at least one actuator with a vibration signal preset for the error operating mode, wherein, comparison to the vibration signal of the normal operating mode, the vibration signal of the error operating mode has: higher pulse amplitudes, a greater proportion of pulse amplitudes above an amplitude threshold, higher mean pulse widths, and/or a greater number of pulses within a signal duration and/or a higher frequency;

controlling the at least one actuator to output at least one first and at least one second ink droplet, such that the output ink droplet inks a randomly selected point of the print image on the recording medium, independently of the print data;

controlling the at least one actuator to output at least one ink droplet with the second volume, such that the output ink droplet inks a randomly selected point of the print image on the recording medium, independently of the print data;

controlling the at least one actuator to output at least one ink droplet with second volume, such that the output ink droplet inks an already inked point of the print image to be generated on the recording medium depending on the print data, wherein the already inked point has been inked with a first color, and the ink droplet has a second color differing from the first color; and controlling the at least one actuator to output an ink droplet having the second volume, wherein the ink droplet inks a predetermined point outside of the print image to be generated.

4. The method according to claim 1, wherein the defective nozzle is detected in response to a detection of the position of the inked point on the recording medium deviating from a predetermined position, and/or in response to a detection of a size of the inked point deviating from a predetermined size, and/or in response to a point to be inked having not been inked.

5. The method according to claim 1, wherein:

the control of the at least one actuator is changed from the normal operating mode to the error operating mode in response to a detection that the nozzle is defective, and the control of the at least one actuator is changed back from the error operating mode to the normal operating mode in response to a detection that the nozzle is no longer defective.

6. The method according to claim 1, further comprising generating an error signal using the sensor and outputting the error signal to a controller at a point in time of detection of a defect of the nozzle, wherein: the controller outputs an error information, the controller terminates a print process, and the controller activates a cleaning process to clean the defective nozzle.

7. The method according to claim 1, wherein, in the error operating mode, a point to be inked of the recording medium is inked, or is partially inked, by the printing element based on the print data, wherein a second actuator is controlled to output an ink droplet having the second volume.

8. A non-transitory computer-readable storage medium with an executable program stored thereon, that when executed, instructs a processor to perform the method of claim 1.

9. An inkjet printing system, comprising:

at least one actuator associated with a nozzle of a printing element; and a controller configured to:

control the at least one actuator to output one or more ink droplets from the nozzle of the printing element;

control the at least one actuator to, in a normal operating mode, output the one or more ink droplets at a predetermined point to be inked of a recording medium based on a print image to be generated, wherein the controlling of the at least one actuator in the normal operating mode to output the one or more ink droplets includes: depending on print data of the print image to be generated, selectively outputting, from the nozzle two ink droplets having a first volume, or a single ink droplet having a second volume larger than the first volume;

determine a time period in which the at least one actuator has not been activated to output the ink droplet;

control the at least one actuator to, given a non-defective nozzle, in a normal operating mode, implement at least one refresh measure in response to the time period exceeding a preset limit value; and control the at least one actuator to, after detection of a defective nozzle by a sensor, in an error operating mode, implement at least one intensified refresh measure, wherein the at least one refresh measure comprises at least one of:

controlling the at least one actuator with a vibration signal preset for the normal operating mode, and/or controlling the at least one actuator to output at least one ink droplet having the first volume such that the output ink droplet inks a randomly selected point of the print image on the recording medium, independently of print data;

controlling the at least one actuator to output an ink droplet having the first volume such that the output ink droplet inks an already printed point of the print image to be generated on the recording medium depending on the print data, wherein the already inked point has been inked with a first color, and the ink droplet has a second color differing from the first color; and controlling the at least one actuator to output an ink droplet having the first volume, wherein the ink droplet inks a predetermined point outside of the print image to be generated.

10. A method for controlling an actuator of an inkjet printing system, comprising:

in a normal operating mode, controlling, by a controller, at least one actuator associated with a printing element, based on a print image to be generated, to output an ink droplet from a nozzle of the printing element to a predetermined point to be inked on a recording medium;

determining, by the controller, a time period in which the at least one actuator has not been activated to output an ink droplet;

with a non-defective nozzle, controlling, by the controller, the at least one actuator in the normal operating mode to implement at least one refresh measure in response to the determined time period exceeding a preset limit value; and in response to a detection of a defective nozzle by a sensor, controlling the at least one actuator, by the controller, to implement at least one intensified refresh measure in an error operating mode, wherein:

the control of the at least one actuator is changed from the normal operating mode to the error operating mode in response to a detection that the nozzle is defective, and the control of the at least one actuator is changed back from the error operating mode to the normal operating mode in response to a detection that the nozzle is no longer defective.

11. A non-transitory computer-readable storage medium with an executable program stored thereon, that when executed, instructs a processor to perform the method of claim 10.

12. An inkjet printing system, comprising:

at least one actuator associated with a printing element; and a controller configured to perform the method of claim 10.

13. A method for controlling an actuator of an inkjet printing system, comprising:

in a normal operating mode, controlling, by a controller, at least one actuator associated with a printing element, based on a print image to be generated, to output one or more ink droplets from a nozzle of the printing element to a predetermined point to be inked on a recording medium, wherein the controlling of the at least one actuator to output one or more ink droplets includes, depending on print data of the print image to be generated, selectively outputting, from the nozzle: two ink droplets having a first volume, or a single ink droplet having a second volume larger than the first volume;

determining, by the controller, a time period in which the at least one actuator has not been activated to output an ink droplet;

with a non-defective nozzle, controlling, by the controller, the at least one actuator in the normal operating mode to implement at least one refresh measure in response to the determined time period exceeding a preset limit value; and in response to a detection of a defective nozzle by a sensor, controlling the at least one actuator, by the controller, to implement at least one intensified refresh measure in an error operating mode, wherein, in the error operating mode, a point to be inked of the recording medium is inked, or is partially inked, by the printing element based on the print data, wherein a second actuator is controlled to output an ink droplet having the second volume.

14. A non-transitory computer-readable storage medium with an executable program stored thereon, that when executed, instructs a processor to perform the method of claim 13.

15. An inkjet printing system, comprising:

at least one actuator associated with a printing element; and a controller configured to perform the method of claim 13.

* * * * *